United States Patent [19]

Clark

[11] 3,942,210

[45] Mar. 9, 1976

[54] BRUSH FRAME AND SHELL

[76] Inventor: Gaylord J. Clark, P.O. Box 710, Coloma, Mich. 49038

[22] Filed: Feb. 7, 1974

[21] Appl. No.: 440,284

[52] U.S. Cl. ..... 15/179; 15/53 A; 15/183

[51] Int. Cl.[2] ..... A46B 7/10

[58] Field of Search ..... 15/179–183, 15/198, 200, 53 A

[56] References Cited

UNITED STATES PATENTS

| | | | |
|---|---|---|---|
| 1,753,201 | 4/1930 | Edlich | 15/181 UX |
| 2,921,329 | 1/1960 | Peterson | 15/183 X |
| 2,929,088 | 3/1960 | Wier, Jr. | 15/181 X |
| 2,970,333 | 2/1961 | Jones | 15/183 |
| 3,036,323 | 5/1962 | Nelson | 15/183 |
| 3,228,053 | 1/1966 | Horton et al. | 15/183 |
| 3,533,125 | 10/1970 | Buechel et al. | 15/183 |

*Primary Examiner*—Peter Feldman

*Attorney, Agent, or Firm*—Woodhams, Blanchard and Flynn

[57] ABSTRACT

A rotary brush construction comprised of a drumlike frame having a plurality of replaceable, semi-cylindrical, bristle-carrying sections removably attached thereto. The brush sections are mounted in opposed pairs on the frame. The means attaching the brush sections to the frame can be easily removed and replaced.

5 Claims, 5 Drawing Figures

BRUSH FRAME AND SHELL

FIELD OF THE INVENTION

This invention relates to a rotary brush construction and, more particularly, to a type thereof having replaceable bristle-carrying shells designed for use in a car-washing operation.

BACKGROUND OF THE INVENTION

The sizes and shapes of automobiles and the types and locations of parts projecting therefrom, such as bumpers and the like, are constantly changing so that rotary brushes used in automatic equipment for washing vehicles are frequently and seriously damaged under circumstances which cannot be adequately anticipated. Thus, it is of great importance to provide a brush construction which can be quickly and easily, hence inexpensively, repaired to minimize loss of money and time, thereby increasing the efficiency in, and profit from, the car washing operation.

It is equally important that the rotary brushes be capable of quick and easy removal and replacement where such is necessitated by the wear and tear of the brush bristles resulting from ordinary use. Further, due to the size and shape of automobiles, and the various parts which project therefrom, selected areas of the brushes are subject to a more rapid rate of wear than are other brush areas. These selected areas, when worn, prevent adequate washing of the vehicle and thus it is often necessary to replace the complete brush assembly or, in the alternative, substantially disassemble and reassemble the complete brush assembly in order to replace a worn section.

Further, with the advent of rubber or other shock absorbing bumpers on the vehicles, it has been discovered that those areas on the brushes which contact the bumpers not only tend to have greatly increased wear, but also have a tendency to "hang-up" or become locked to the car bumper. This can result in damage to the vehicle, brush or both.

The increased wear caused by vehicle projections, such as bumpers, obviously requires substantially increased maintenance and replacement of the brushes. Likewise, the potential damage which worn brushes can cause to the vehicles has increased the maintenance required and has thus decreased the profit of such car-washing operations.

Many attempts have been made to produce brushes which would successfully overcome the above-mentioned disadvantages, and one such brush construction is disclosed in my prior U.S. Pat. No. 3,439,373. However, in a continuing effort to improve upon, and reduce the cost of, the procedure of replacing worn or damaged brushes or brush bristles, while at the same time increase brush wear, I found that much time could be saved by constructing the brush from a plurality of removable arcuate brush sectors which could also have the bristle density thereof varied as desired to result in optimum washing and wear characteristics relative to the configuration of the vehicles.

Accordingly, a primary object of this invention is the provision of an improved rotary brush structure which provides a rotary drumlike hub or frame having a plurality of removable arcuate brush sections mounted thereon. The brush sections preferably comprise semicylindrical shells which are mounted in opposed pairs on the hub. Several pairs may be disposed axially adjacent one another along the length of the hub. This brush structure thus enables individual worn sections to be easily removed and replaced without requiring disassembly of the entire brush construction. At the same time, this structure permits various brush sections to be axially interchanged or their orientation reversed to provide for more uniform wear on all of the brush sections.

A further object of the present invention is to provide an improved brush construction, as aforesaid, which enables the arcuate brush sections to be attached to or removed from the hub in a simple manner while at the same time the arcuate brush sections can be individually economically constructed.

Still a further object of the present invention is to provide an improved brush construction, as aforesaid, which is extremely durable but of rather light weight so as to facilitate the mounting and driving thereof to thus minimize wear on the bearings and other associated driving parts.

Other objects and purposes of the invention will be apparent to persons familiar with rotary brush constructions upon reading the following description and examining the accompanying drawings.

For convenience in the following description, the terms "inner", "outer" and words of similar import will have reference to the central axis of the rotary brush construction and designated parts thereof.

SUMMARY OF THE INVENTION

The objects and purposes of the invention, including those set forth above, have been met by providing a rotary hub structure having a plurality of bristle-carrying brush sections removably attached thereto. The brush sections preferably comprise substantially semicylindrical shells which are disposed in opposed pairs on the hub. The individual brush sections are secured to the hub by removable means, such as by a single threaded fastening member extending through the center of each brush section and fixedly anchored to the hub. The hub, in a preferred embodiment, is formed from a plurality of axially spaced disklike support members which are secured to a central shaft, which support members are fixedly connected by angularly spaced, axially extending mounting bars to which the brush sections are fixedly connected.

DETAILED DESCRIPTION

Figure 1:
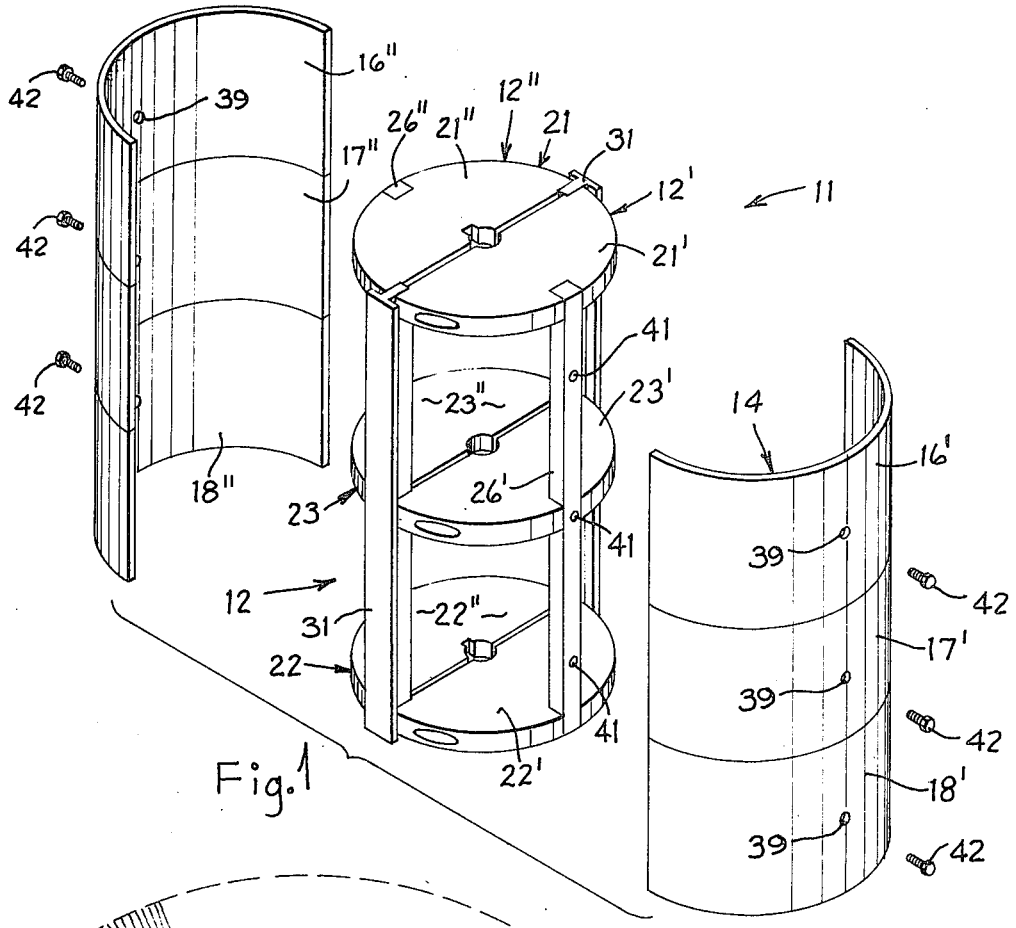
FIG. 1 is an exploded, perspective view of a rotary brush construction according to the present invention, the arcuate brush segments depicted in FIG. 1 being illustrated with the bristles removed therefrom for clarity of illustration.
Figure 3:
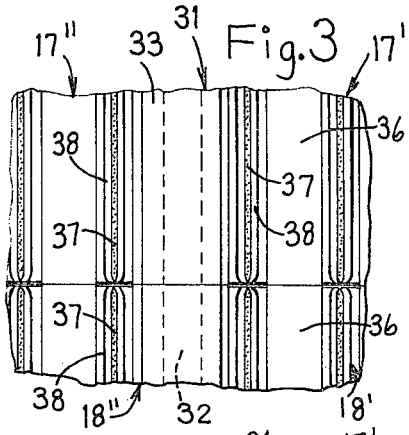
FIG. 3 is a fragmentary view taken substantially along the line III—III in FIG. 2.
Figure 2:
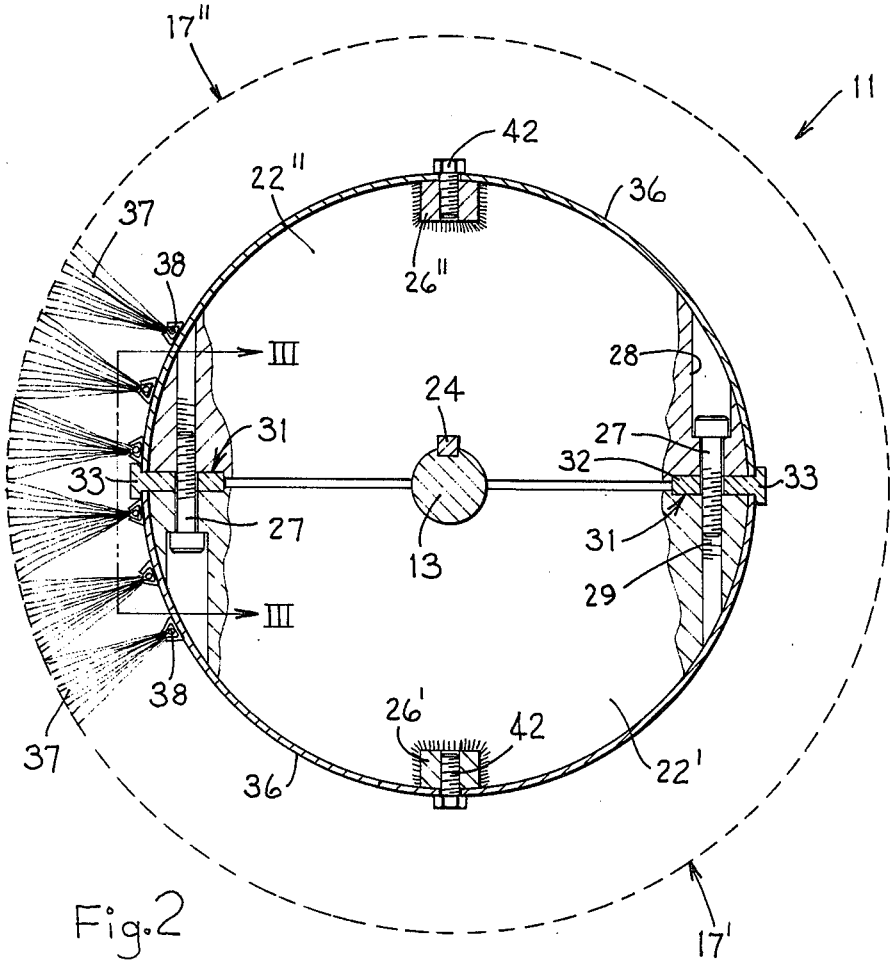
FIG. 2 is a fragmentary cross-sectional view of a brush construction according to the present invention and including therein the hub structure illustrated in FIG. 1.

Referring to the drawings, FIGS. 1–3 illustrate therein one embodiment of the present invention wherein the brush construction 11 includes a drumlike hub assembly 12 adapted to be nonrotatably secured on a supporting shaft 13. A plurality of substantially identical bristle-carrying brush sections 14 are adapted to be removably secured to the drum assembly 12. The brush sections 14 have been illustrated in FIG. 1 with the bristles removed for purposes of illustration only. Further, the brush sections 14 are disposed in opposed pairs when mounted on the hub assembly, and a plurality of said opposed pairs are mounted axially along the hub assembly. For purposes of subsequent identification, the opposed pairs of brush sections have been identified as 16'-16'', 17'-17'' and 18'-18'' in FIG. 1.

Considering now the hub assembly 12, same includes (for purposes of illustration only) a pair of end collars 21 and 22 and an intermediate collar 23 disposed substantially midway therebetween. The end collar 21 is constructed from a pair of separable, substantially semi-cylindrical, platelike segments 21' and 21'' which, when assembled around the shaft 13, comprise an annular disklike support. The other end collar 22 is similarly constructed and includes a pair of semi-cylindrical segments 22' and 22'', and the intermediate collar 23 similarly includes a pair of opposed semi-cylindrical segments 23' and 23''. The end collars 21 and 22 are suitably nonrotatably connected to the shaft 13, as by a conventional key 24, for enabling the hub assembly 12 to be nonrotatably connected to the shaft 13.

The collar segments 21', 22' and 23' are fixedly connected in axially spaced relationship to one another by an elongated connecting bar 26' extending therebetween. The connecting bar 26' is fixedly connected to these collar segments, such as by welding, to maintain the segments in substantially parallel relationship. The connecting bar 26', as illustrated in FIG. 1, is disposed substantially at the midpoint of the external arcuate periphery of the segments and, when the segments are mounted on the shaft 13, extends substantially parallel to the rotational axis of the shaft.

The opposite collar segments 21'', 22'' and 23'' are similarly fixedly connected by a further elongated bar 26'' which extends between and is fixedly connected to the respective collar segments. The connecting bar 26' and its associated collar segments thus results in one relatively rigid hub subassembly, and the connecting bar 26'' and its associated segments results in a second substantially rigid hub subassembly, which two subassemblies can then be mounted on or removed from the shaft 13 by movement in a radial direction relative to the shaft. The use of these hub subassemblies not only facilitates the mounting or removing of the hub assembly from the shaft, but also greatly simplifies storing and shipping of the hub structure. Further, when the two hub subassemblies are mounted on the shaft, the connecting bars 26' and 26'' are disposed on substantially diametrically opposite sides of the shaft 13, as illustrated in FIGS. 1 and 2.

The hub subassemblies 12' and 12'' are here illustrated as fixedly connected to the shaft 13 by pairs of threaded fastening members, specifically screws 27, which screws fixedly connect the coacting pairs of collar segments. As illustrated in FIG. 2, each collar segment has a bore 28 formed in one end thereof and a threaded bore 29 formed in the other end thereof whereby when the segments are disposed directly opposite one another, the bores 28 and 29 are aligned. The screws 27 are received within the bores 28 and threadably engage the bores 29 for fixedly connecting the collar segments together.

The hub assembly 12 further includes a pair of elongated and substantially opposed bars 31 which, in the illustrated embodiment of FIG. 1, are of a T-shaped cross-section and extend axially throughout the length of the hub, being disposed substantially parallel to and on diametrically opposite sides of the shaft 13. The T-bars, which are spaced at an angle of approximately 90° from the connecting bars 26' and 26'', are disposed at the interface of the opposed collar segments and are suitably clamped therebetween. For this purpose each T-bar 31 includes a center web portion 32 which projects inwardly between the opposed pairs of collar segments, such as between the segments 22' and 22'' illustrated in FIG. 2. The web portion 32 also includes a suitable opening therein associated with each collar for enabling the connecting screw 27 to extend therethrough, whereby the screws 27 thus cause the opposed pairs of segments to be moved toward one another into clamping engagement with the web portion 32. Each T-bar 31 also includes a head or flange portion 33 provided on the radially outer end of the web portion 32, which head portion 33 projects substantially perpendicular to the web portion 32 and is spaced radially outwardly a predetermined distance from the outer periphery of the collar segments for a purpose to be explained hereinafter.

Considering now the brush sections 14, and referring specifically to FIG. 2 wherein the brush segments 17' and 17'' are illustrated, only the brush section 17' will be described in detail since all of the brush sections are substantially identical.

The brush section 17' includes an arcuate support plate 36, which support plate can be constructed from a substantially rectangular piece of steel plate and then rolled into the desired arcuate configuration. The support plate 36, in this illustrated embodiment, has the inside surface thereof generated about a radius which is substantially equal to the outer radius of the collars 21, 22 and 23 when mounted on the shaft 13. Further, the support plate 36 in the illustrated embodiment extends through an angle of approximately 180° and is thus substantially semi-cylindrical. The support plate 36 has a plurality of conventional bristles 37 mounted thereon and projecting radially outward thereof, which bristles are mounted on the plate 36 in any conventional manner. In the illustrated embodiment, the bristles 37 are fixedly clamped within elongated channel-shaped members 38 which are fixedly secured, as by spot welding, to the outer surface of the support plate 36. As illustrated in FIG. 3, the plate 36 is provided with a plurality of substantially parallel channel-shaped members 38 fixedly secured thereto and extending axially thereof, which members 38 are spaced from one another. Each member 38 has a plurality of bristles 37 mounted therein. The construction of the channel members 38 carrying the bristles 37 therein, and the manner in which they are attached to the support plates 36, is explained in detail in my prior U.S. Pat. No. 3,439,373.

For mounting the brush sections 14 on the hub assembly 12, each support plate 36 is provided with a center opening 39 therein. Further, each connecting bar 26′ and 26″ is provided with a plurality of axially spaced threaded bores 41 therein which are adapted to align with the openings 39. A conventional threaded fastener 42, such as a screw, extends through each opening 39 and threadably engages the bore 41 for fixedly connecting each of the brush sections 14 to the hub assembly 12. The support plates 36 associated with each brush section 14 have a width which is substantially equal to the spacing between the threaded bores 41 so that the axially adjacent brush sections, such as the section 16′, 17′ and 18′, when mounted on the hub assembly 12 are disposed with their adjacent axial edges closely adjacent one another.

Further, when the brush sections 14 are mounted on the hub assembly 12, the opposite free ends of each support plate 36 are slidably but snugly disposed beneath the laterally projecting flange portions 33, which flange portions 33 thus retain the free edges of the individual brush sections directly adjacent the periphery of the collar segments. The flange portions 33 thus prevent the free ends of the brush segments from being deflected outwardly away from the hub assembly, either due to centrifugal force or due to the brush bristles being caught or hung up on the vehicle.

Figure 4:
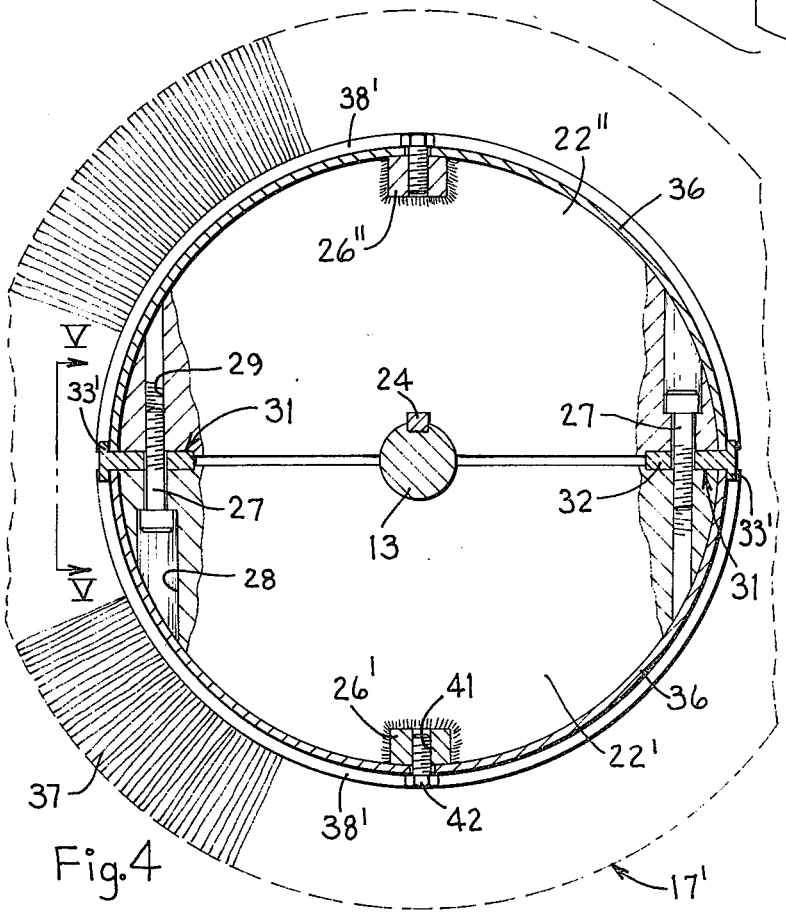
FIG. 4 is a cross-sectional view of a brush construction similar to that illustrated in FIG. 2 but wherein the brush segments are mounted within channels which extend spirally of the hub.
Figure 5:
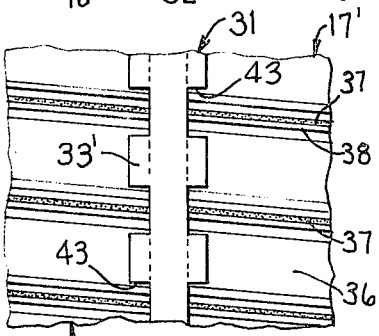
FIG. 5 is a fragmentary view taken substantially along the line V—V in FIG. 4.

FIGS. 4 and 5 respectively correspond to FIGS. 2 and 3 but illustrate therein a brush construction which is a slight modification of the brush construction illustrated in FIGS. 2 and 3. In this embodiment, the channel-shaped members 38′ extend circumferentially of the plate 36 so as to likewise extend circumferentially of the hub assembly 12 when the bristle-carrying sections are mounted thereon. The channel-shaped members 38′ may extend either circumferentially of the plate 36 as to be disposed within a plane which is substantially perpendicular to the axis of the shaft 13, or the members 38′ may extend at an angle relative to this plane (as illustrated in FIG. 5) to thus spiral around the hub assembly.

As illustrated in FIG. 5, the flange portion 33′ of each T-bar 31 may be provided with opposed pairs of clearance notches 43 formed therein and spaced substantially uniformly therealong. The notches 43, which notches are spaced consistent with the spacing between the channel members 38′, thus enables the bristle-carrying members 38 to extend to the free edge of the respective support plates 36 to thus minimize the circumferential gap or discontinuity which is created between the aligned bristle-carrying members 38 as formed on the adjacent pair of brush segments. Except for the above-mentioned structural variations, the brush construction of FIGS. 4 and 5 is in all other respects identical to the brush construction illustrated in FIGS. 1–3.

The utilization of the brush constructions of the present invention on an overall vehicle washing apparatus are substantially conventional and self-explanatory in view of the detailed description set forth above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rotary brush construction having rotatable hub means, a plurality of arcuate bristle-carrying brush sections mountable on said hub means, and connecting means for removably mounting the individual brush sections on said hub means, comprising the improvement wherein:

said hub means includes a pair of axially spaced collars adapted to be mounted nonrotatably upon a shaft, and a pair of circumferentially spaced, axially elongated and substantially parallel connecting elements extending axially between and fixedly connected to said pair of collars, said connecting elements being disposed adjacent the peripheries of said collars;

said connecting means coacting between the respective brush sections and one of said connecting elements for individually fixedly connecting the brush sections to said hub means; and said hub means also including a pair of circumferentially spaced and substantially parallel connecting members extending axially between said pair of collars, said connecting members projecting outwardly beyond the peripheries of said collars and including laterally projecting flange means spaced outwardly from the peripheries of said collars and disposed for overlapping the adjacent free edges of the brush sections.

2. A brush construction according to claim 1, wherein said connecting elements are disposed substantially diametrically opposite one another, wherein said connecting members are disposed substantially diametrically opposite one another, said connecting elements being individually spaced by an angle of approximately 90° from the connecting members, and said connecting members having at least a portion thereof with a substantially T-shaped cross section.

3. A brush construction according to claim 2, wherein said hub means includes a third collar disposed axially between said pair of collars, each of said collars including a pair of substantially semi-cylindrical disklike segments, each coacting pair of disklike segments being fixedly coupled together in surrounding relationship to a shaft for fixing same in nonrotatable relationship relative to the shaft, each said connecting element fixedly interconnecting the axially aligned segments of the collars and being disposed substantially at the midpoint of the external arcuate periphery thereof, and said connecting members being positioned at the interface between the coacting pairs of disklike segments, said connecting members having a platelike portion projecting radially inwardly between the opposed pairs of disklike segments and clampingly held therebetween.

4. In a rotary brush construction having rotatable hub means, a plurality of arcuate bristle-carrying brush sections mounted on said hub means, and connecting means for removably mounting the individual brush sections on said hub means, comprising the the improvement wherein each said brush section includes an arcuate substantially semi-cylindrical shell having a plurality of bristles mounted thereon and projecting radially outwardly thereof, a pair of said shells being mounted substantially diametrically opposite one another when mounted on said hub means, said connecting means comprising threaded fastener means extending between and fixedly interconnecting each said shell to said hub means, and edge restraining means for preventing the axially extending edges of said shells from deflecting radially outwardly away from said hub means during rotation of said brush contruction, said edge restraining means including a pair of circumferentially spaced and substantially parallel restraining members extending axially of said hub means and fixedly connected thereto, said restraining member being disposed between the adjacent axially extending edges of a pair of said shells and projecting outwardly beyond the periphery of said hub means, said restraining member including laterally projecting flange means spaced outwardly from the periphery of said hub means and disposed for snugly overlapping the adjacent free axially extending edges of the shells.

5. A brush construction according to claim 4, wherein said restraining member is of a substantially T-shaped cross section having a center web portion and a transversely extending head portion, said head portion defining said flange means, said hub means including a pair of substantially semi-cylindrical hub portions disposed diametrically opposite one another, the web portion of said restraining member being positioned between the opposed faces of the hub portions, and threaded connector means extending between and fixedly interconnecting the opposed hub portions and said web portion.

* * * * *